US005763153A

United States Patent [19]

Tsuzuki et al.

[11] Patent Number: 5,763,153

[45] Date of Patent: Jun. 9, 1998

[54] PHOTOTHERMOGRAPHIC MATERIAL

[75] Inventors: Hirohiko Tsuzuki; Yoshio Inagaki, both of Minami Ashigara, Japan

[73] Assignee: Fuji Photo Film Co. Ltd, Kanagawa, Japan

[21] Appl. No.: 727,932

[22] Filed: Oct. 9, 1996

[30] Foreign Application Priority Data

Oct. 9, 1995 [JP] Japan ..... 7-261376

[51] Int. Cl.[6] ..... G03C 1/498

[52] U.S. Cl. ..... 430/584; 430/619

[58] Field of Search ..... 430/584, 619

[56] References Cited

U.S. PATENT DOCUMENTS

| | | | |
|---|---|---|---|
| 3,660,102 | 5/1972 | Riester . | |
| 5,387,502 | 2/1995 | Inagaki | 430/584 |
| 5,541,054 | 7/1996 | Miller et al. . | |

*Primary Examiner*—Thorl Chea

*Attorney, Agent, or Firm*—Birch, Stewart, Kolasch & Birch, LLP

[57] ABSTRACT

A photothermographic material containing photosensitive silver halide grains, in which a cyanine dye containing at least one of an alkylthio group, an arylthio group, and a substituent group having a thioether bond is included, thereby the photographic material exhibiting low fogging, high sensitivity, and improved stability.

10 Claims, No Drawings

PHOTOTHERMOGRAPHIC MATERIAL

FIELD OF THE INVENTION

The present invention relates to a photothermographic material.

BACKGROUND OF THE INVENTION

In the medical field, in view of environmental protection and space saving, reduction in waste processing solution has been largely expected in recent years. As to photothermographic materials for medical diagnosis and photographic techniques, this demands the progress of techniques which makes it possible to efficiently expose the photographic materials to light by use of a laser imagesetter or a laser imager and to form black images having high resolving power and sharpness. In these photothermographic materials, a heat developable processing system which needs no processing chemicals for a solution system and can be more easily processed without impairing environment can be supplied for customers.

On the other hand, the techniques for semiconductor lasers which are recently making rapid progress have enabled medical image output devices to be miniaturized. Consequently, the techniques for infrared ray-sensitive photothermographic materials for which semiconductor lasers can be used as light sources have also been developed. The techniques for spectral sensitization for the materials are disclosed in JP-B-3-10391 (The term "JP-B" as used herein means an "examined Japanese patent publication"), JP-B-6-52387, JP-A-5-341432 (The term "JP-A" as used herein means an "unexamined published Japanese patent application"), JP-A-6-194781, and JP-A-6-301141, and further, the techniques for antihalation are disclosed in JP-A-7-13295 and U.S. Pat. No. 5,380,635. In the photosensitive materials for which exposure to infrared rays is a prerequisite, sensitizing dyes and antihalation dyes are allowed to have largely low absorption in the region of visible light to easily prepare substantially colorless photosensitive materials.

However, spectral sensitizing dyes absorbing infrared rays have a tendency to reduce silver ion in the photosensitive materials and suffer deterioration in fogging, because these dyes generally possess strong reducing power due to high HOMOs thereof. In particular, these photosensitive materials have the disadvantage of undergoing marked changes in performance on storage under the conditions of high temperature and high humidity or on storage for a long period of time. Use of dyes possessing lower HOMOs, in which the LUMOs also become relatively low, results in decreasing spectral sensitization efficiency to cause sensitivity decrease of the photosensitive materials. Such disadvantages in sensitivity and storability are more significant in photothermographic materials to which the present invention relates than in wet type photographic materials.

It is a matter of course that use of large quantities of the dyes increases reducing capacity of the dyes.

However, use of small quantities of the dyes results in poor sensitivity because of insufficient absorption of light incident on the photosensitive materials. In particular, in the photothermographic materials in which binders having strong affinities to oil are used, weak adsorption of the dyes to silver halides which are photosensitive elements causes poor sensitivity, unless sufficient quantities of the dyes are added.

SUMMARY OF THE INVENTION

An object of the present invention is to provide an infrared ray-sensitive photothermographic material which exhibits satisfactory storability, low fogging, and in addition, high sensitivity.

The object can be achieved by the following means:

(1) A photothermographic material containing photosensitive silver halide grains on at least one side of a support, in which a cyanine dye containing at least one of alkylthio groups, arylthio groups and substituent groups having a thioether bond is included.

(2) A photothermographic material containing on at least one side of a support, a binder, an organic silver salt, a reducing agent for silver ion, and photosensitive silver halide grains, in which a cyanine dye containing at least one of alkylthio groups, arylthio groups, and substituent groups each having a thioether bond is included.

(3) A photothermographic material described in (1) or (2), in which said photosensitive silver halide grains are spectrally sensitized in the range of 750 to 1,400 nm.

(4) A photothermographic material described in (1) to (3), in which said cyanine dye has a quinoline nucleus.

(5) A photothermographic material described in (1) to (4), in which said cyanine dye has at least one substituent group having a thioether bond.

(6) A photothermographic material described in (1) to (3), in which said cyanine dye is represented by the following formula (I):

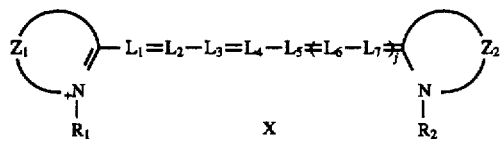

(I)

wherein R, and $R_2$ each represents an alkyl group; $Z_1$ and $Z_2$ each represents an atomic group necessary to complete a 5- or 6-membered nitrogen-containing heterocycle; $L_1$, $L_2$, $L_3$, $L_4$, $L_5$, $L_6$, and $L_7$ each represents a methine group, or $L_2$ and $L_4$, $L_3$ and $L_5$, or $L_4$ and $L_6$ may bond to each other to form a ring; j represents 0 or 1; X represents a counter ion to keep balance of the electric charges, or X may be a substituent group on $Z_1$, $Z_2$, $R_1$ or $R_2$ to form an internal salt with the cyanine dye; and at least one of $R_1$, $R_2$, $Z_1$ and $Z_2$ is substituted by an alkylthio group, an arylthio group, or a substituent group having a thioether bond.

(7) A photothermographic material described in (6), in which $Z_1$ is an atomic group for completing a quinoline nucleus.

(8) A photothermographic material described in (6) or (7), in which, in formula (I), at least one of $R_1$, $R_2$, $Z_1$ and $Z_2$ are substituted with a substituent group having a thioether bond.

(9) A photothermographic material described in (6) or (8), in which, in formula (I), at least one of $R_1$ and $R_2$ are substituted with an alkylthio group, an arylthio group, or a substituent group having a thioether bond.

DETAILED DESCRIPTION OF THE INVENTION

The present invention is described in detail below.

The cyanine dyes containing at least one of alkylthio groups, arylthio groups, and substituent groups each having a thioether bond, which can be used in the present invention, have already been known. Examples of such cyanine dyes are described in JP-A-62-58239, JP-A-3-138638, JP-A-3-138642, JP-A-4-255840, JP-A-5-72659, JP-A-5-72661, JP-A-6-222491, JP-A- 2-230506, JP-A-6-258757, JP-A-6-317868, JP-A-6-324425, and JP-W-7-500926 (The term "JP-W" as used herein means an "unexamined published international patent application").

The cyanine dyes used preferably in the present invention are represented by the following formula (I):

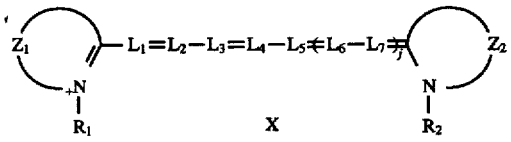

(I)

wherein $R_1$ and $R_2$ each represents an alkyl group; $Z_1$ and $Z_2$ each represents an atomic group necessary to complete a 5- or 6-membered nitrogen-containing heterocycle; $L_1$, $L_2$, $L_3$, $L_4$, $L_5$, $L_6$, and $L_7$ each represents a methine group, or $L_2$ and $L_4$, $L_3$ and $L_5$, or L4 and $L_6$ may bond to each other to form a ring; j represents 0 or 1; X represents a counter ion to keep balance of the electric charges, or X may be a substituent group on $Z_1$, $Z_2$, $R_1$, or $R_2$ to form an internal salt with the cyanine dye; and at least one of $R_1$, $R_2$, $Z_1$, and $Z_2$ is substituted by an alkylthio group, an arylthio group, or a substituent group having a thioether bond.

The alkylthio group, arylthio group, and substituent group each having a thioether bond by which at least one of $R_1$, $R_2$, $Z_1$ and $Z_2$ is substituted are described below.

Said alkylthio groups used preferably are those having 1 to 8 carbon atoms, which may further be substituted by an aryl group (phenyl, 4-chlorophenyl, etc.), an alkylthio group (methylthio, 2-hydroxyethylthio, etc.), an alkoxy group (methoxy, 2-hydroxy-2-methylethyl, 2-methoxyethoxy, etc.), a hydroxyalkyl group (2-hydroxyethyl, etc.), or a halogen atom (F, Cl, Br, or I). Of these groups, unsubstituted alkylthio groups having 1 to 4 carbon atoms are particularly preferred. Examples of said alkylthio groups include a methylthio group and a n-hexylthio group.

Said arylthio groups used preferably are a phenylthio group and phenylthio groups which may further be substituted by an alkyl group (methyl, t-amyl, etc.), an alkylthio group (methylthio, 2-hydroxyethylthio, etc.), an alkoxy group (methoxy, 2-hydroxy-2-methylethyl, 2-methoxyethoxy, etc.), a hydroxyalkyl group (2-hydroxyethyl, etc.), a halogen atom (F, Cl, Br, or I), or a hydroxy group. Of these groups, particularly preferred phenylthio groups are a phenylthio group, phenylthio groups substituted by a halogen atom, phenylthio groups substituted by an alkyl group having 1 to 4 carbon atoms, phenylthio groups substituted by an alkoxy group having 1 to 4 carbon atoms, and phenylthio groups substituted by an alkylthio group having 1 to 4 carbon atoms. More concrete examples of said arylthio groups include a phenylthio group and a 4-methylphenylthio group.

Said substituent groups having a thioether bond which are preferably used are alkylthioalkyl groups having 2 to 8 carbon atoms, or alkylthiophenyl groups or phenylthioalkyl groups having 7 to 10 carbon atoms. These groups may further be substituted by an alkyl group (methyl, t-amyl, etc.), an alkylthio group (methylthio, 2-hydroxyethylthio, etc.), an alkoxy group (methoxy, 2-hydroxy-2-methylethyl, 2-methoxyethoxy, etc.), a hydroxyalkyl group (2-hydroxyethyl, etc.), a halogen atom (F, Cl, Br, or I), or a hydroxy group. More concrete examples of said substituent groups containing a thioether bond include 3-methylthiopropyl and 2-phenylthioethyl. The thioether bond may be a part of a cyclic structure (e.g., thiophene ring, thiazole ring).

When $Z_1$ and $Z_2$ in formula (I) contain an alkylthio group, an arylthio group, or a substituent group having a thioether bond, the alkylthio and arylthio group is rather preferred to the other.

Examples of 5- or 6-membered nitrogen-containing heterocycles formed by atomic groups represented by $Z_1$ and $Z_2$ are given below, with the proviso that designations of these heterocycles are shown not as quaternary salts but as non-ionic type compounds as a matter of convenience.

That is, they include a thiazole nucleus (for example, thiazole, 4-methylthiazole, 4-phenylthiazole, 4,5-dimethylthiazole, and 4,5-diphenylthiazole), a benzothiazole nucleus (for example, benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenylbenzothiazole, 5-fluorobenzothiazole, 5-chloro-6-methylbenzothiazole, 5,6-dimethylthiobenzothiazole, 5,6-dimethylbenzothiazole, 5-hydroxy-6-methylbenzothiazole, tetrahydrobenzothiazole, and 4-phenylbenzothiazole), naphthothiazole nuclei (for example, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 8-methylthionaphtho[1,2-d]thiazole and 5-methoxynaphtho[2,3-d[thiazole), a thiazoline nucleus (for example, thiazoline, 4-methylthiazoline, and 4-nitrothiazoline), an oxazole nucleus (for example, oxazole, 4-methyloxazole, 4-nitrooxazole, 5-methyloxazole, 4-phenyloxazole, 4,5-diphenyloxazole, and 4-ethyloxazole), a benzoxazole nucleus (benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, and 5-ethoxybenzoxazole), naphthoxazole nuclei (for example, naphtho(2,1-d]oxazole, naphtho[1,2-d]oxazole, naphtho[2,3-d]oxazole, and 5-nitronaphtho[2,1-d]oxazole), an oxazoline nucleus (for example, 4,4-dimethyloxazoline), a selenazole nucleus (for example, 4-methylselenazole, 4-nitroselenazole, and 4-phenylselenazole), a benzoselenazole nucleus (for example, benzoselenazole, 5-chlorobenzoselenazole, 5-nitrobenzoselenazole, 5-methoxybenzoselenazole, 5-hydroxybenzoselenazole, 6-nitrobenzoselenazole, and 5-chloro-6-nitrobenzoselenazole), naphthoselenazole nuclei (for example, naphtho[2,1-d)selenazole, and naphtho[1,2-d)selenazole), a 3,3-dialkylindolenine nucleus (for example, 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, and 3,3-dimethyl-5-chloroindolenine), imidazole nuclei (for example, 1-alkylimidazole, 1-alkyl-4-phenylimidazole, 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-alkylnaphtho[1,2-d]imidazole, 1-allyl-5,6-dichlorobenzimidazole, 1-allyl-5-chlorobenzimidazole, 1-arylimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole, 1-arylnaphtho[1,2-d]imidazole [The alkyl groups which are substituent groups on the above-mentioned heterocycle preferably are those having 1 to 8 carbon atoms, for example, unsubstituted alkyl groups such as methyl, ethyl, propyl, isopropyl, or butyl; or hydroxyalkyl groups such as 2-hydroxyethyl or 3-hydroxypropyl. Of these groups, a methyl group and an ethyl group are particularly preferred. The above-mentioned aryl groups include a phenyl group, phenyl groups substituted by a halogen atom (for example, chlorine), phenyl groups substituted by an alkyl group (for example, methyl), and phenyl groups substituted by an alkoxy group (for example, methoxy)], a pyridine nucleus (for example, 2-pyridine, 5-methyl-2-pyridine, and 3-methyl-4-pyridine), quinoline nuclei (for example, 2-quinoline, 3-methyl-2-quinoline, 5-ethyl-2-quinoline, 6-methyl-2-quinoline, 6-phenyl-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-phenyl-4-quinoline, 8-chloro-4-quinoline, 8-fluoro-4-quinoline, 8-methyl-4-quinoline, 8-methoxy-4-quinoline, isoquinolin, 6-nitro-1-isoquinoline, 3,4-dihydro-1-isoquinoline, and 6-nitro-3-isoquinoline), an imidazo[4,5-b]quinoxaline nucleus (for example, 1,3-diethylimidazo[4,5-b]quinoxaline and 6-chloro-1,3-diallylimidazo[4,5-b]quinoxaline), a benzotellurazole nucleus (for example, benzotellurazole, 5-methylbenzotellurazole, and 5-methoxybenzotellurazole), a naphthotellurazole nucleus (for example, naphtho[1,2-d]tellurazole), oxadiazole nuclei, thiadiazole nuclei, tetrazole nuclei, and a pyrimidine nucleus.

The atomic groups represented by $Z_1$ and $Z_2$ which are necessary to form 5- or 6-membered nitrogen-containing heterocycles are preferably those forming a benzothiazole nucleus, a benzoxazole nucleus, a benzimidazole nucleus, naphthoxazole nuclei, naphthothiazole nuclei, or a quinoline nucleus. In formula (I), the combination that j is 0, and one of $Z_1$ and $Z_2$ is a benzothiazole nucleus or naphthothiazole nucleus and the other is 4-quinoline nucleus is particularly preferred.

The atomic groups represented by $Z_1$ and $Z_2$ which are necessary to form 5- or 6-membered nitrogen-containing heterocycles may contain substituent groups other than alkylthio groups, arylthio groups, or substituent groups having a thioether bond. Examples of such substituent groups include alkyl groups having 1 to 8 carbon atoms (for example, methyl, ethyl, trifluoromethyl, propyl, and isopropyl), halogen atoms (for example, fluorine, chlorine, bromine, and iodine), aryl groups (for example, phenyl, chlorophenyl, bromophenyl, methylphenyl, and methoxyphenyl), alkoxy groups (for example, methoxy, ethoxy, propoxy, butoxy, benzyloxy, 2-methoxyethoxy, 2-hydroxyethoxy, and 2-methoxy-2-methylethoxy), alkoxycarbonyl groups (for example, methoxycarbonyl, ethoxycarbonyl, and benzyloxycarbonyl), a cyano group, a nitro group, and a hydroxy group.

The alkyl groups represented by $R_1$ and $R_2$ are straight-chain, branched-chain, or cyclic alkyl groups which preferably have 1 to 8 carbon atoms, and may further contain substituent groups other than alkylthio groups, arylthio groups, and substituent groups having a thioether bond. It is particularly preferred that at least one of $R_1$ and $R_2$ have a substituent group having an alkylthio group, an arylthio group or a thioether group.

Examples of the substituent groups include a carboxyl group, a sulfo group, a cyano group, halogen atoms (for example, fluorine, chlorine, and bromine), a hydroxy group, alkoxycarbonyl groups (preferably having 8 or less carbon atoms; for example, methoxycarbonyl, ethoxycarbonyl and benzyloxycarbonyl), alkoxy groups (preferably having 7 or less carbon atoms; for example, methoxy, ethoxy, propoxy, butoxy, and benzyloxy), alkylthio groups (preferably having 7 or less carbon atoms; for example, methylthio and 2-methylthioethylthio), aryloxy groups (preferably having 15 or less; for example, phenoxy, p-tolyloxy and α-naphthoxy), acyloxy groups (preferably having 3 or less carbon atoms; for example, acetyloxy and propionyloxy), acyl groups (preferably having 8 or less carbon atoms; for example, acetyl, propionyl, benzoyl, and mesyl), carbamoyl groups (for example, carbamoyl, N,N-dimethylcarbamoyl, morpholinocarbamoyl, and piperidinocarbamoyl), sulfamoyl groups (for example, sulfamoyl, N,N-diemthylsulfamoyl and morpholinosufonyl), and alkyl groups substituted by aryl groups (for example, phenyl, p-hydroxyphenyl, p-carboxyphenyl, p-sulfophenyl, and α-naphthyl) (The alkyl moieties preferably have 1 to 6 carbon atoms). The alkyl groups represented by $R_1$ and $R_2$ may be substituted by combinations of two or more of these substituent groups.

The methine groups represented by $L_1$ to $L_7$ may contain substituent groups, examples of which include alkyl groups (preferably having 1 to 6 carbon atoms), aryl groups (for example, phenyl), aralkyl groups (for example, benzyl), alkoxy groups (for example, methoxy and ethoxy), alkylthio groups (for example, methylthio and ethylthio), arylthio groups (for example, phenylthio and naphthylthio), and amino groups (for example, diphenylamino). These groups may further contain substituent groups. $L_2$ and $L_4$, $L_3$ and $L_5$, or $L_4$ and $L_6$ may combine to form rings, which are preferably 5- or 6-membered rings consisting of carbon atoms. Such rings have, for example, the following skeletons (a), (b), and (c), and may further contain substituent groups (for example, methyl, methylthio, phenylthio, or diphenylamino).

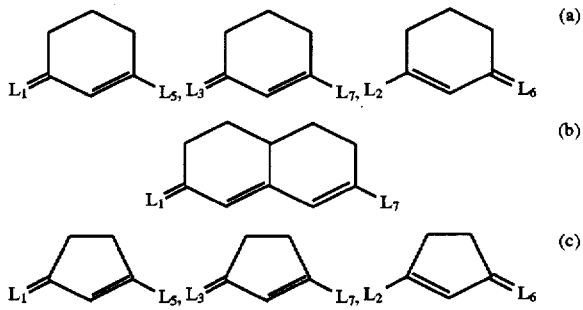

The counter ions represented by X are cations or anions selected so that the sum of electric charges of the compounds represented by formula (I) becomes zero, or X may be a substituent group on $Z_1$, $Z_2$, $R_1$ or $R_2$ so that the compound represented by formula (I) can form an internal salt.

Examples of the cations include $Na^+$, $K^+$, and $(n\text{-}C_4H_9)_4N^+$. Examples of the anions include acid anions (for example, chloride, bromide, iodide, tetrafluoroborate, hexafluoro-phosphate, methylsulfate, ethylsulfate, benzenesulfonate, 4-methylbenzenesulfonic, 4-chlorobenzenesulfonate, 4-nitrobenzenesulfonate, trifluoromethanesulfonate, and perchlorate).

The compounds represented by formula (I) of the present invention can be easily prepared by reference to a series of specifications in which the above-mentioned cyanine dyes containing alkylthio groups, arylthio groups, or substituent groups having a thioether bond are described. Further, for synthetic methods of various cyanine dyes, for example, the following reference books can be referred to: F. M. Hammer, *The Cyanine Dyes and Related Compounds*, (Interscience Publishers, N.Y., 1964), infra page 55; Nikolai Tyutyulkov, Jurgen Fabian, Achim Ulehlhorn, Fritz Dietz, and Alia Tadjier, *Polymethine Dyes*, St. Kliment Ohridski University Press, Sophia, pages 23–38; and *Research Disclosure*, Vol. 152, page 48 (1976).

Examples of the cyanine dyes used in the present invention are shown below. However, the cyanine dyes used in the present invention are not limited to these examples.

1-1

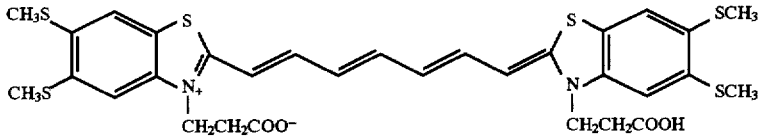

1-2

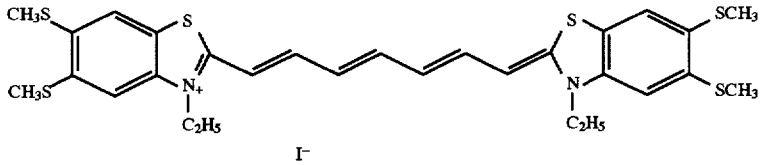

1-3

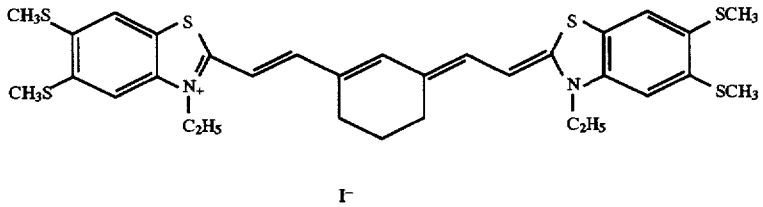

1-4

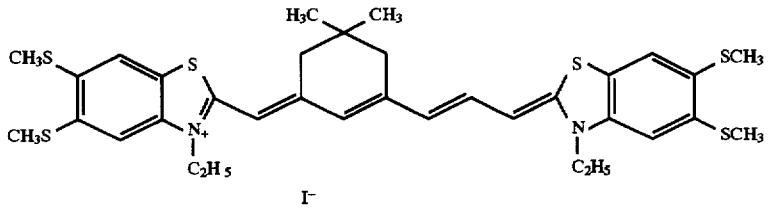

1-5

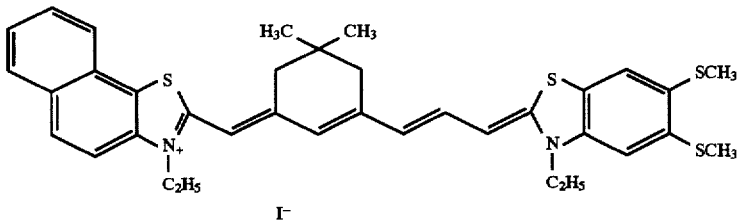

1-6

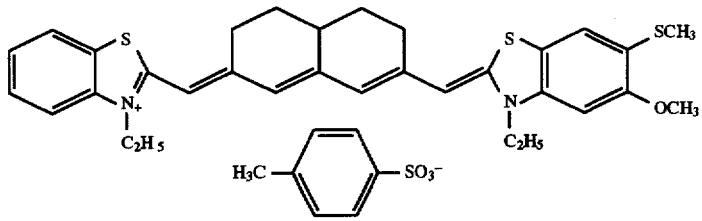

1-7

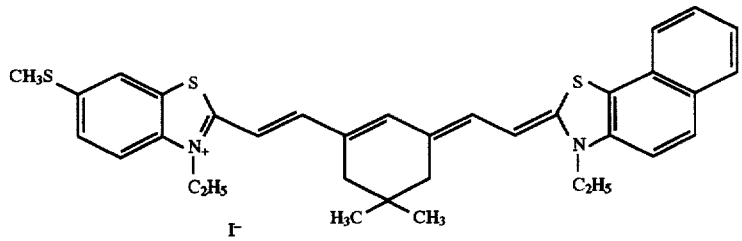

-continued
1-8
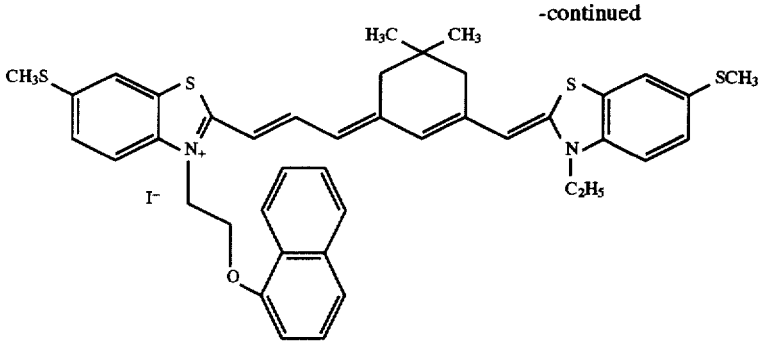
1-9
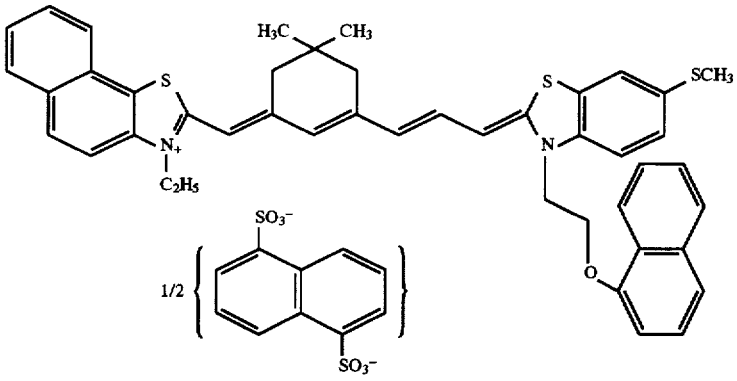
1-10
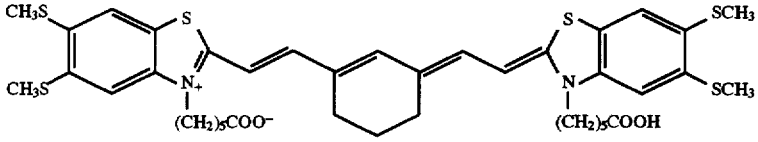
1-11
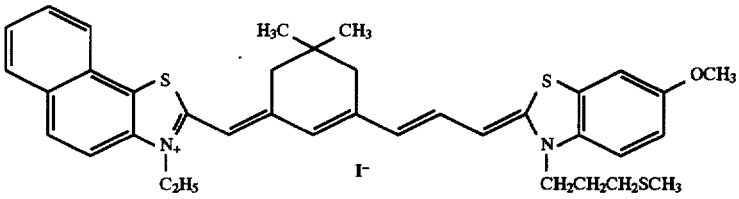
1-12
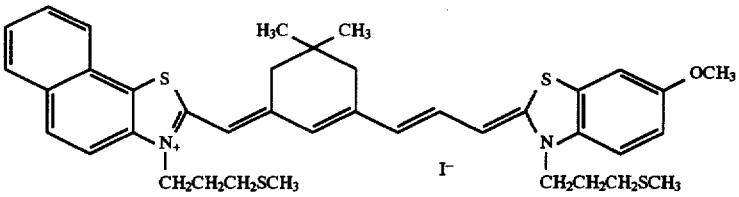
1-13
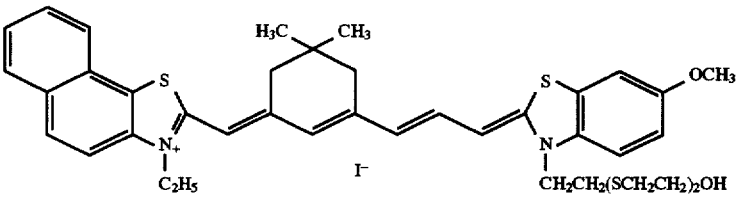
1-14
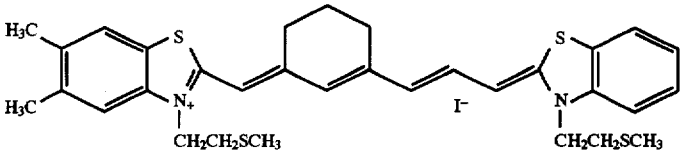

-continued
1-15
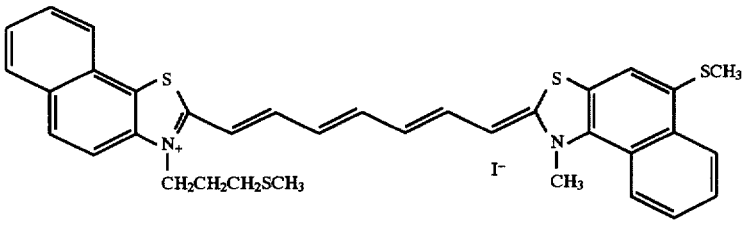
1-16
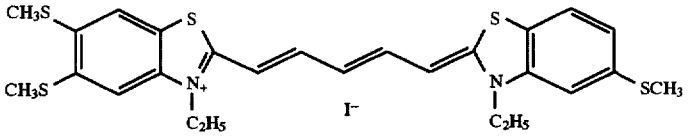
1-17
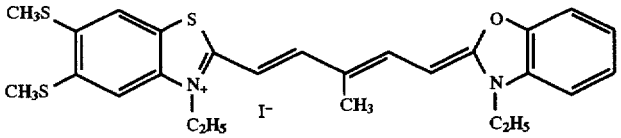
1-18
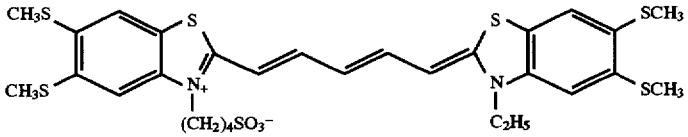
1-19
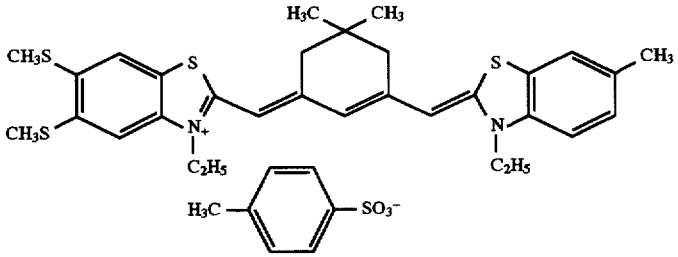
1-20
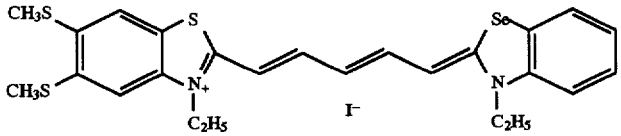
1-21
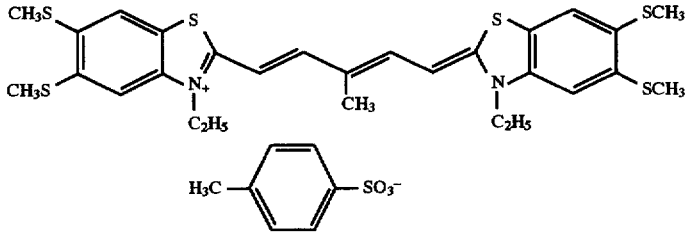
1-22
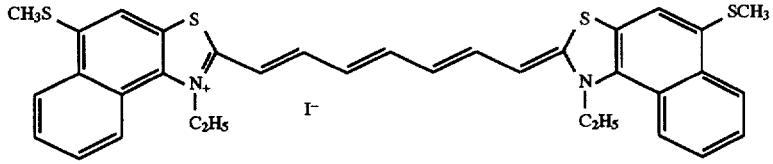

-continued
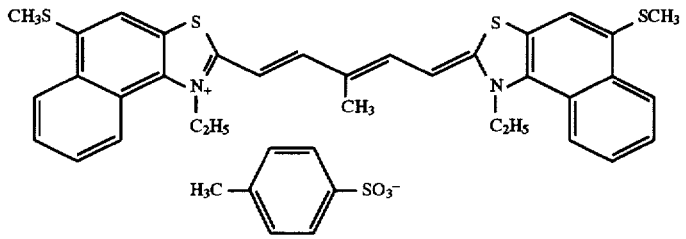
1-23
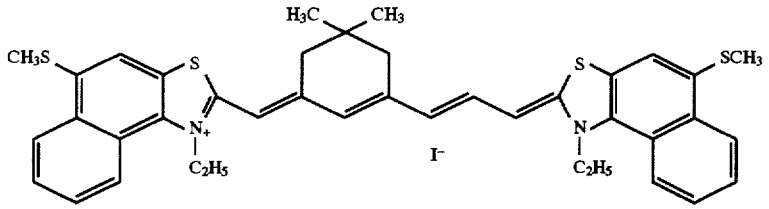
1-24
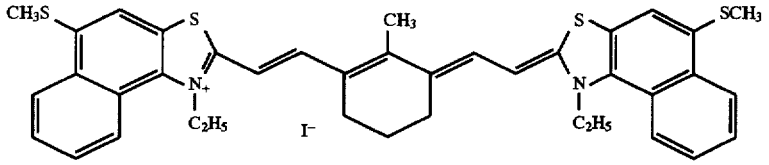
1-25
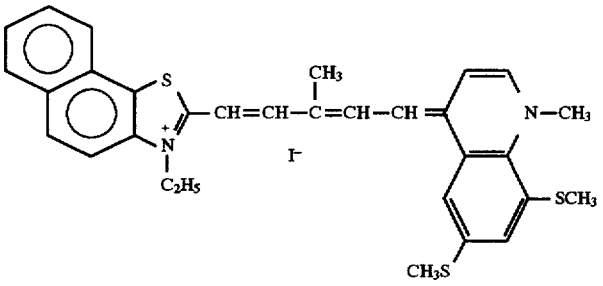
I-26
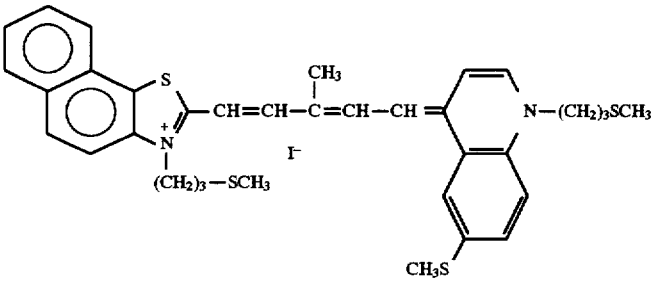
I-27
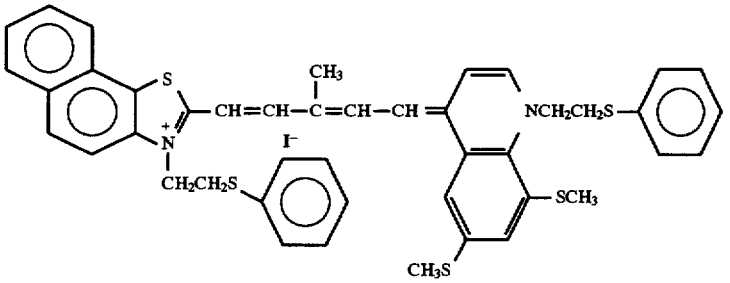
I-28

-continued
I-29
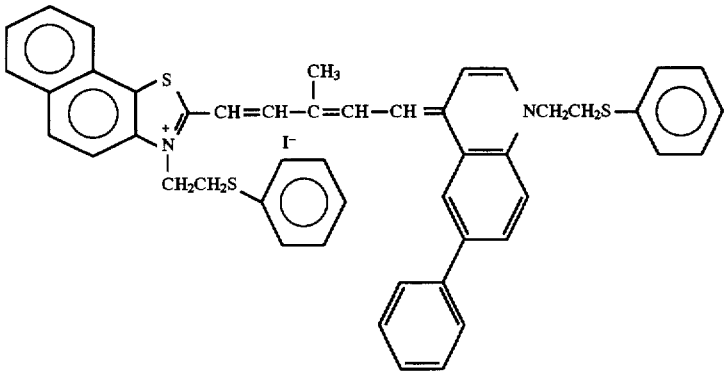
I-30
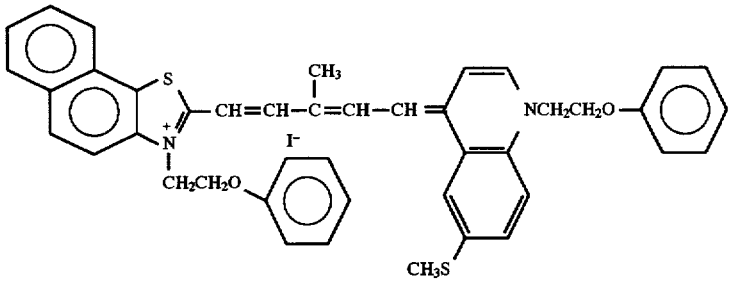
I-31
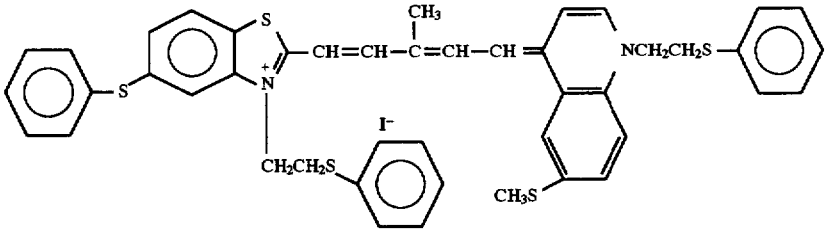
I-32
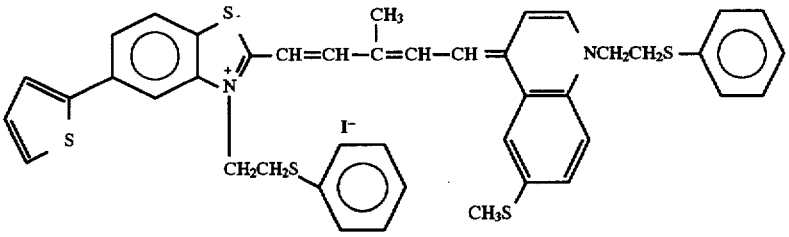
I-33
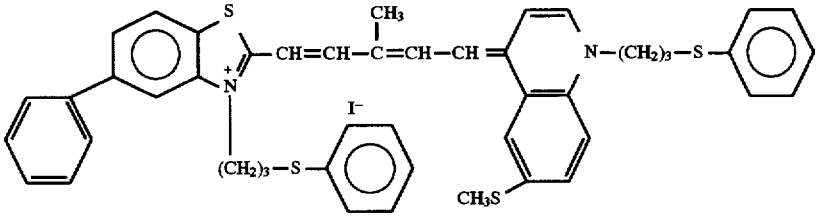
I-34
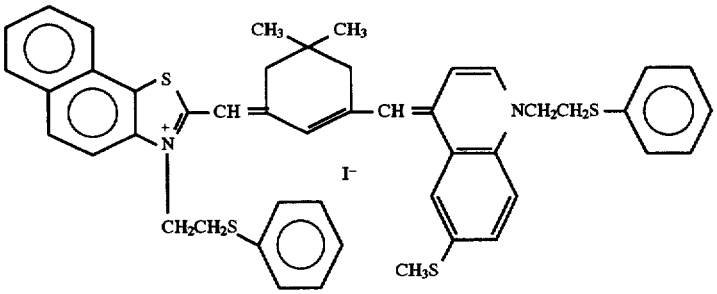

-continued
I-35
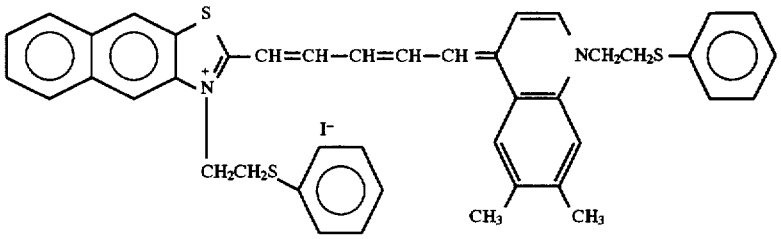
I-36
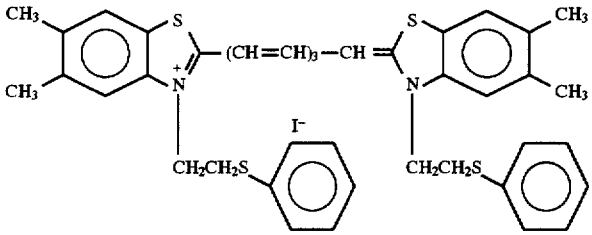
I-37
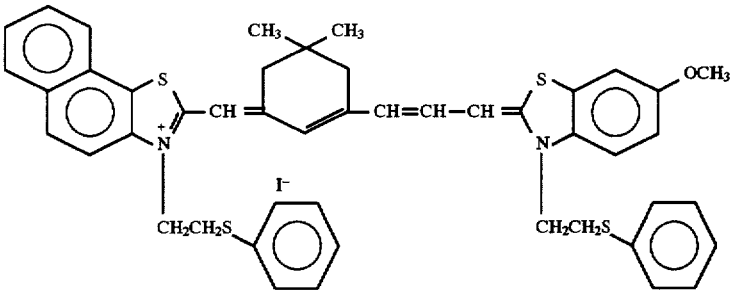
I-38
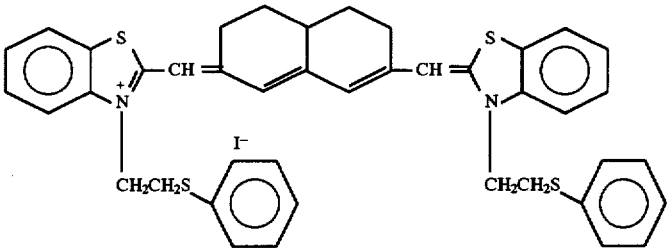
I-39
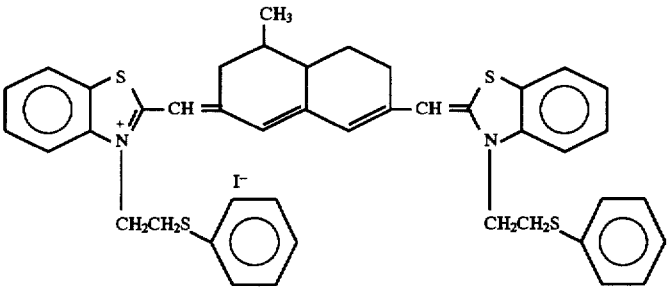
I-40
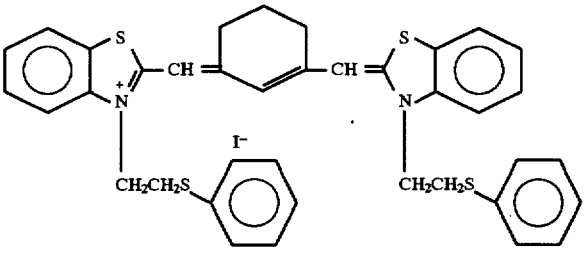

-continued

I-41

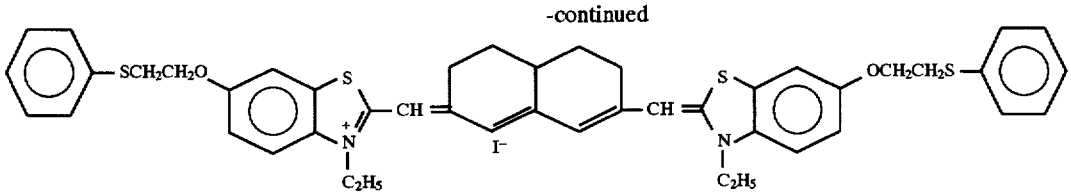

I-42

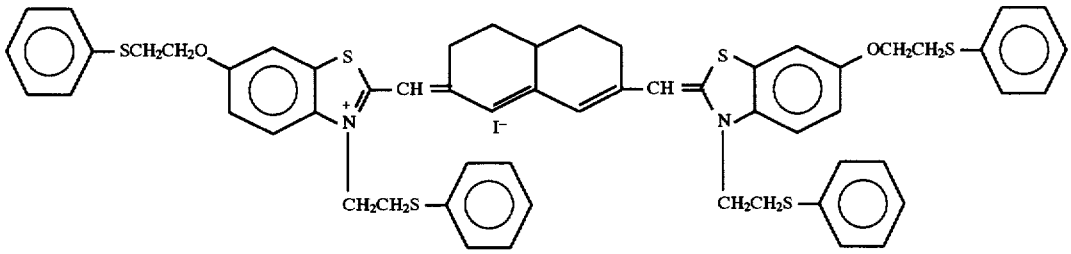

I-43

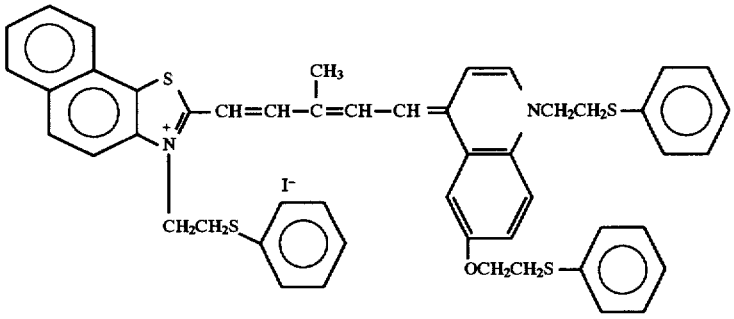

I-44

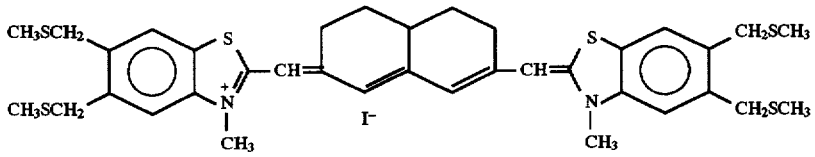

I-45

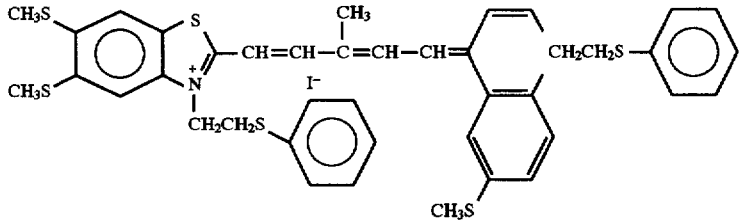

In the present invention, the cyanine dyes are preferably used in an amount of from $10^{-6}$ to 1 mole per mole of silver halides, and more preferably from $10^{-5}$ to $10^{-2}$ mole.

Although addition of the cyanine dyes can be performed at any step from silver halide formation to immediately before coating, it is preferred that the addition is performed immediately before coating.

Desired spectral sensitization spectra can be obtained by using a plurality of the cyanine dyes of the present invention.

For the sensitization of the present invention, other sensitizing dyes than the cyanine dyes of the present invention may also be used together therewith. Such sensitizing dyes are preferably those which can spectrally sensitize silver halide grains at wavelengths ranging from 750 to 1,400 nm. For example, various known dyes which include cyanine, merocyanine, styryl, hemicyanine, oxanol, hemioxanol and xanthene dyes can spectrally advantageously sensitize photosensitive silver halides. Useful cyanine dyes are those having basic nuclei such as a thiazoline nucleus, an oxazoline nucleus, a pyrroline nucleus, a pyridine nucleus, an oxazole nucleus, a thiazole nucleus, a selenazole nucleus, and an imidazole nucleus. Useful merocyanine dyes used preferably are those having, as well as the above-mentioned basic nuclei, acidic nuclei such as a thiohydantoin nucleus, a rhodanine nucleus, an oxazolidinedione nucleus, a thiazolinedione nucleus, a barbituric acid nucleus, a thiazolinone nucleus, a malononitrile nucleus and a pyrazolone nucleus. Of these cyanine and merocyanine dyes, dyes containing an imino group or a carboxyl group are particularly effective. In particular, known dyes as described in U.S. Pat. Nos. 3,761,279, 3,719,495 and 3,877,943, British Patents 1,466,201, 1,469,117 and 1,422,057, JP-B-3-10391, JP-B-6-52387, JP-A-5-341432, JP-A-6-194781, and JP-A-6-301141 can also be suitably used. These dyes used together with the cyanine dyes of the present invention can be generally used in an amount of about $10^{-5}$ to about 1 mole per mole of silver halides. Desired spectral sensitization spectra can also be obtained by using a plurality of these dyes.

The photothermographic material of the present invention is preferably the so-called one side photosensitive material, in which a photosensitive layer containing at least one silver halide emulsion is formed on one side of a support and a backing layer is formed on another side thereof.

When the photothermographic material of the present invention is an one side photosensitive material matting agents may be added to improve the transportability thereof. The matting agents are generally water-insoluble organic or inorganic fine grains. Matting agents known well in this industry can be arbitrarily employed, which include organic matting agents described, for example, in U.S. Pat. Nos. 1,939,213, 2,701,245, 2,322,037, 3,262,782, 3,539,344, 3,767,448, etc. and inorganic matting agents described in U.S. Pat. Nos. 1,260,772, 2,192,241, 3,257,206, 3,370,951, 3,523,022, 3,769,020, etc. Examples of organic compounds used preferably as the matting agents include, as water-dispersible vinyl polymers, polymethyl acrylate, polymethyl methacrylate, polyacrylonitrile, acrylonitrile-α-methylstyrene copolymer, polystyrene, styrene-divinylbenzene copolymer, polyvinyl acetate, polyethylene carbonate, and polytetrafluoroethylene; as cellulose derivatives, methyl cellulose, cellulose acetate, and cellulose acetate propionate; as starch derivatives, carboxy starch, carboxy nitrophenyl starch, and a reaction product of urea, formaldehyde and starch; and gelatin hardened with known hardening agents and hardened gelatin formed as fine encapsulated hollow particles through coacervate hardening. Examples of the inorganic compounds used preferably as the matting agents include silicon dioxide, titanium dioxide, magnesium dioxide, aluminum oxide, barium sulfate, calcium carbonate, silver chloride and silver bromide desensitized by a known method, glass, and diatomaceous earth. These matting agents can be mixed with different kinds of substances as needed. Although the size and shape of the matting agents are not particularly limited and can be appropriately selected, the matting agents having particle sizes of 0.1 to 30 μm are preferably used to perform the present invention. Particle size distributions of the matting agents may be either narrow or broad. On the other hand, the matting agents have a marked effect on the haze or surface luster of photosensitive materials, and therefore, it is preferred that the size, shape, and size distribution of particles are adjusted on preparing matting agents or by mixing a plurality of matting agents so as to meet requirements.

In the present invention, the degree of matting of a backing layer is preferably from 250 seconds or less to 10 seconds or more in Beck's smoothness, and more preferably from 180 seconds or less to 50 seconds or more.

In the present invention, the matting agents are preferably contained in the most outer surface layer, a layer functioning as the most outer surface layer, or a layer in close proximity to the most outer surface, and further, preferably contained in a layer acting as the so-called protective layer.

In the present invention, binders used suitably for the backing layer are transparent or translucent, generally colorless natural polymers, synthetic resins, polymers, or copolymers, or other film forming media. Examples thereof include gelatin, gum arabic, poly(vinyl alcohol), hydroxyethyl cellulose, cellulose acetate, cellulose acetate butyrate, poly(vinylpyrrolidone), casein, starch, poly(acrylic acid), poly(methyl methacrylate), poly(vinyl chloride), poly (methacrylic acid), copoly(styrene-maleic anhydride), copoly(styrene-acrylonitrile), copoly(styrene-butadiene), poly(vinyl acetals) (for example, poly(vinyl formal) and poly(vinyl butyral), polyesters, polyurethanes, phenoxy resins, poly(vinylidene chloride), polyepoxides, polycarbonates, poly(vinyl acetate), cellulose esters and polyamides. Binders may be formed by coating from in water, organic solvents, or emulsions.

In the present invention, the backing layer preferably has maximal absorption of 0.3 or more to 2 or less in the range of 750 to 1,400 nm, and more preferably maximal absorption of 0.5 or more to 2 or less in the infrared region and of 0.001 or more to 0.5 or less in the visible region, and the layer is more preferably an antihalation layer having an optical density of 0.001 or more to 0.3 or less.

When antihalation dyes are used in the present invention, any of compounds can be used as the dyes, if the compounds have desired absorption in the range of 750 to 1,400 nm and sufficiently weak absorption in the visible region, and give desired shapes of absorption spectra for the above-mentioned backing layer. Examples of such compounds include compounds described in JP-A-7-13295 and U.S. Pat. No. 5,380,635; and compounds described in JP-A-2-68539, page 13, lower left column, line 1 to page 14, lower left column, line 9 and JP-A-3-24539, page 14, lower left column to page 16, lower right column. The present invention is not limited by these compounds.

A backside resistive heating layer as described in U.S. Pat. No. 4,460,681 and 4,374,921 can also be used for the photothermographic image system.

The photothermographic materials of the present invention are composed of one or more layers having photosensitive silver halide grains formed on a support. In an one-layer structure, the layer preferably contains an organic silver salt, a silver halide, a developing agent, a binder, and materials added as needed which include a toning agent, a covering additive, and other additives. In a two-layer structure, an organic silver salt and a silver halide are contained in the first emulsion layer (usually adjacent to a support), and some other components are contained in the second layer or both of the first and second layers. However, a two-layer structure comprising a single emulsion layer containing all components and a protective top coat also is possible. Multicolor photosensitive photothermographic materials may comprise these two-layer structures about each color, or may have a structure where one layer of the respective two-layer structures may contain all components as described in U.S. Pat. No. 4,708,928. In the multiple dye multicolor photosensitive photothermographic materials, the emulsion layers are generally separated from one another by forming functional or nonfunctional barrier layers between the respective photosensitive layers as described in U.S. Pat. No. 4,460,681.

It may be often advantageous to add mercury(II) salts to the emulsion layers as antifoggants, although they are not necessarily required to execute the present invention. The mercury(II) salts used preferably for this purpose are mercury acetate and mercury bromide. The photosensitive silver halides used in the present invention generally range from 0.75 to 25 mol% of organic silver salts, and preferably from 2 to 20 mol%.

Any of photosensitive silver halides such as silver bromide, silver iodide, silver chloride, silver bromoiodide, silver chlorobromoiodide, and silver chlorobromide can be used as silver halide. The silver halides are photosensitive, and may have any forms of cubic form, orthorhomic form, tabular form, and tetrahedral form. Their crystal forms are not limited to these, and epitaxial growth thereon may also be allowed.

In the present invention, these silver halides can be used without any modification. However, they can be subjected to chemical sensitization by use of chemical sensitizers such as compounds containing sulfur, selenium, or tellurium; compounds containing gold, platinum, palladium, rhodium, or iridium; reducing agents such as stannous halides; or combinations thereof. The procedures are described in detail in T. N. James, *The Theory of the Photographic Process*, the fourth edition, Chapter 5, page 149–169.

The silver halides can be added to the emulsions so as to lie in close proximity to organic silver salts on which the silver halides act as catalysts according to any procedures. The silver halides and organic silver salts which have been separately formed in binders or preformed can be mixed prior to use thereof to prepare coating solutions, or it is also effective to mix both of them in a ball mill for a long period of time. Further, there is also an effective method of adding halogen-containing compounds to organic silver salts prepared beforehand so that a portion of silver of the organic silver salts converts to the silver halides. These methods of preparing and mixing the silver halides and organic silver salts are known in this industry, and described in *Research Disclosure*, (June, 1978), Item 17029 and U.S. Pat. No. 3,700,458. In the present invention, it is preferred that silver halides which are formed beforehand in the absence of organic silver salts are used.

The preformed silver halide emulsions may not be washed or may be washed to remove soluble salts. In the latter case, the soluble salts may be removed from the emulsions either by cooling coagulation and leach or by coagulation and washing. The silver halide grains may have any of crystal forms such as cubic form, tetrahedral form, orthorhomic form, tabular form, layer form, and plate form. However, the crystal forms of the silver halide grains used are not limited to these forms.

The organic silver salts usable in the present invention form silver images by heating to 80° C. or higher in the presence of exposed photocatalysts (silver halides, etc.) and reducing agents, although they are relatively stable to light. The organic silver salts can be any organic substances containing sources which can reduce silver ion. Silver salts of organic acids, particularly, long chain aliphatic carboxylic acids (having 10 to 30 carbon atoms, and preferably 15 to 28 carbon atoms) are preferred. Complexes of organic or inorganic silver salts having ligands with overall stability constants ranging from 4.0 to 10.0 are also preferred. The organic silver salt substances should preferably comprise about 5 to about 30% by weight of image formation layers. Preferred organic silver salts are silver salts of carboxyl group-containing organic compounds such as aliphatic and aromatic carboxylic acids, although they are not limited to these compounds. Examples of preferred silver aliphatic carboxylates include silver behenate, silver stearate, silver oleate, silver laurate, silver caproate, silver myristate, silver palmitate, silver maleate, silver fumarate, silver tartrate, silver linoleate, silver butyrate, silver camphorate, and mixtures thereof.

Compounds containing mercapto groups or thione groups and derivatives thereof can also be used. Examples of such compounds used preferably include silver salts of 3-mercapto-4-phenyl-1,2,4-triazole, 2-mercaptobenzimidazole, 2-mercapto-5-aminothiadiazole, and 2-(ethylene glycolamido)benzothiazole, thioglycollic acids such as S-alkyl-thioglycollic acids (Herein the alkyl groups have 12 to 22 carbon atoms), dithiocarboxylic acids such as dithioacetic acid, thioamides, 5-carboxyl-1-methyl-2-phenyl-4-thiopyridine, mercaptotriazines, and 2-mercaptobenzoxazole; silver salts of 1,2,4-mercaptothiazole derivatives such as 3-amino-5-benzylthio-1,2,4-thiazole as described in U.S. Pat. No. 4,123,274; and silver salts of thione compounds such as 3-(3-carboxyethyl)-4-methyl-4-thiazoline-2-thione as described in U.S. Pat. No. 3,301678. Further, silver salts of imino group- containing compounds can also be used. Examples of these compounds used preferably include silver salts of benzotriazoles and derivatives thereof, for example, silver salts of benzotriazoles such as methylbenzotriazoles and silver salts of halogen-substituted benzotriazoles such as 5-chlorobenzotriazole; silver salts of 1,2,4-triazoles or 1H-tetrazoles as described in U.S. Pat. No. 4,220,709, and silver salts of imidazole and derivatives thereof. Various silver acetylide compounds as described in U.S. Pat. Nos. 4,761,361 and 4,775,613 can also be used.

Half soap of silver is known to be conveniently used. Above all things, preferred examples thereof are silver behenate prepared by precipitation from an aqueous solution of commercially available behenic acid, of which silver found by analysis occupies about 14.5%, and an equimolar mixture of behenic acid. A transparent sheet material on a transparent film back base is required to form a transparent coat, and therefore, full soap of behenic acid in which silver found by analysis occupies about 25.2% and free behenic acid not exceeding 4 to 5% is contained may be used. Methods of preparing silver soap dispersions are well known in this technical field, which are disclosed in *Research Disclosure* (April, 1983), Item 22812, ibid, (October, 1983), Item 23419 and U.S. Pat. No. 3,985,565.

Reducing agents for the organic silver salts may be any substances, preferably organic substances, which can reduce silver ion to metallic silver. Although conventional photographic developing agents such as Phenidone, hydroquinone, and catechol are useful, hindered phenol reducing agents are preferred. The reducing agents should comprise 1 to 10% by weight of image formation layers. In the multilayer structures, it is often preferred to add the reducing agents in somewhat higher proportions ranging from about 2 to about 15% by weight, when the reducing agents are added to other layers than the emulsion layers.

A wide variety of reducing agents can be applied to the photothermographic materials for which the organic silver salts are utilized. Examples thereof include amidoximes such as phenylamidoxime, 2-thienylamidoxime and p-phenoxyphenylamidoxime; azines such as 4-hydroxy-3,5-dimethoxybenzaldehyde azine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamines, reductones and/or hydrazines (for example, combinations of hydroquinone with bis(ethoxyethyl)hydroxylamine, piperidinohexose reductone, or formyl-4-methylphenylhydrazine); hydroxamic acids such as phenylhydroxamic acid, p-hydroxyphenylhydroxamic acid and β-anilinehydroxamic acid; combinations of azines with sulfonamidophenols (for example, a combination of phenothiazine with 2,6-dichloro-4-benzenesulfonamidophenol); α-cyanophenylacetic acid derivatives such as ethyl α-cyano-2-methylphenylacetate and ethyl α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl) methane; combinations of bis-β-naphthols with 1,3-dihydroxybenzene derivatives such as 2,4-dihydroxybenzophenone or 2,4-dihydroxyacetophenone; 5-pyrazolones such as 3-methyl-1-phenyl-5-pyrazolone; reductones such as dimethylaminohexose reductone, anhydrodihydroaminohexose reduction and anhydrodihydropiperidonehexose reductone; sulfonamidophenol reducing agents such as 2,6-dichloro-4-benzenesulfonamidophenol and p-benzenesulfonamidophenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol) and 2,2-bis(3,5-dimethyl-4-hydroxyphenyl)propane; ascorbic acid derivatives such as 1-ascorbyl palmitate and ascorbyl stearate; aldehydes and ketones such as benzil and biacetyl; and 3-pyrazolidone and some indane-1,3-diones.

In addition to the above-mentioned components, additives known as toning agents for improving images may be advantageously added. The toning agents are allowed to exist in amounts of 0.1 to 10% by weight of total silver holding components. The toning agents are materials known in photographic techniques as described in U.S. Pat. Nos. 3,080,254, 3,847,612 and 4,123,282.

Examples of the toning agents include phthalimide and N-hydroxyphthalimide; cyclic imides such as succinimide, pyrazoline-5-one, quinazolinone, 3-phenyl-2-pyrazoline-5-one, 1-phenylurazol, quinazoline, and 2,4-thiazolidinedione; naphthalimides (for example, N-hydroxy-1,8-naphthalimide); cobalt complexes (for example, cobalt hexamine trifluoroacetate); mercaptans such as 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl)aryldicarboxyimides (for example, N,N-dimethylaminomethyl)phthalimide and N,N-(dimethylaminomethyl)-naphthalene-2,3-dicarboxyimide); blocked pyrazoles, isothiuronium derivatives, and some light-fading agents (for example, N,N'-hexamethylenebis(1-carbamoyl-3,5-dimethylpyrazole, 1,8-(3,6-diazaoctane)bis (isothiuronium trifluoroacetate) and 2-tribromomethylsulfonylbenzothiazole); 3-ethyl-5[(3-ethyl-2-benzothiazolinylidene)-1-methylethylidene]-2-thio-2,4-oxazolidinedione; phthalazinone, derivatives and metallic salts thereof, and derivatives such as 4-(1-naphthyl) phthalazinone, 6-chlorophthalazinone, 5,7-dimethoxyphthalazinone, and 2,3-dihydro-1,4-phthalazinedione; combinations of phthalazinone with phthalic acid derivatives (for example, phthalic acid, 4-methylphthalic acid, 4-nitrophthalic acid and tetrachlorophthalic anhydride); quinazolinedione, benzoxazine and naphthoxazine derivatives; rhodium complexes functioning not only as toning agents but also as sources of halide ions for silver halide formation in emulsions (for example, ammonium hexachlororhodate(III), rhodium bromide, rhodium nitrate, potassium hexachloro- rhodate(III)); inorganic peroxides and persulfates (for example, ammonium disulfide peroxide and hydrogen peroxide); benzoxazine-2,4-diones such as 1,3-benzoxazine-2,4-dione, 8-methyl-1,3-benzoxazine-2,4-dione and 6-nitro-1,3-benzoxazine-2,4-dione); pyrimidines and as-triazines (for example, 2,4-dihydroxypyrimidine and 2-hydroxy-4-aminopyrimidine); and azauracil and tetraazapentalene derivatives (for example, 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene).

To enhance sensitivity and prevent fog, the photothermographic material of the present invention may contain benzoic acids. The benzoic acid for use in the present invention may be benzoic acid derivatives. Preferred structures thereof include compounds described in U.S. Pat. Nos. 4,784,939 and 4,152,160 and Japanese Patent Application Nos. Hei. 8-151242, 8-151241 and 8-98051. The benzoic acids for use in the present invention may be added to any portion of the photosensitive material. The benzoic acid for use in the present invention is preferably added to a layer coated on the support side on which a photosensitive layer is coated, more preferably to a layer containing an organic silver salt. The timing of adding the bonzoic acid may be any stage of the preparation of coating liquid, and, in the case of adding to a layer containing the organic silver acid, may be any stage from the preparation of organic silver acid to the preparation of coating liquid, preferably a stage after the preparation of organic silver salt and just before the coating. The benzoic acid for use in the present invention may be added by any method (e.g., using powder, solution or fine particle dispersion). The benzoic acid for use in the present invention may be added as a solution thereof mixed with the other additives (e.g., sensitizing dye, reducing agent, toning agent). The addition amount of the benzoic acid for use in the present invention is not particularly limited, but is preferably 1 μmol to 2 mol, more preferably 1 mmol to 0.5 mol based on 1 mol of silver.

A method for forming color images by use of the photothermographic material of the present invention is described in JP-A-7-13295, page 10, left column, line 43 to page 11, left column, line 40. Stabilizing agents for dye image are further described in British Patent 1,326,889 and U.S. Pat. Nos. 3,432,300, 3,698,909, 3,574,627, 3,573,050, 3,764,337, and 4,042,394.

The silver halide emulsions and/or organic silver salts of the present invention can further be prevented from forming additional fog, and protected against the sensitivity decrease thereof during storage by use of antifoggants, stabilizing agents, or precursors of the stabilizing agents. Examples of the suitable antifoggants, stabilizing agents, and precursors of the stabilizing agents which can be used alone or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechols described in U.S. Pat. No. 3,235,652, oximes, nitrons, and nitroindazoles described in British Patent 623,448, polyvalent metallic salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365, and 4,459,350, and phosphorus compounds described in U.S. Pat. No. 4,411,985.

For the photosensitive layers of the present invention, polyhydric alcohols (for example, glycerin and diols described in U.S. Pat. No. 2,960,404), fatty acids or esters thereof described in U.S. Pat. Nos. 2,588,765 and 3,121,060, silicone resins described in British Patent 955,061 can be employed as plasticizers and lubricants.

To prevent the image formation layers from adhesion, surface protective layers can be provided in the photosensitive materials of the present invention. Any anti-adhesion materials can be used for the surface protective layers. Examples of the anti-adhesion materials include wax, silica particles, styrene-containing elastomeric block copolymers (for example, styrene-butadiene-styrene, styrene-isoprene-styrene), cellulose acetate, cellulose acetate butyrate, cellulose propionate, and mixtures thereof.

In the present invention, photographic elements containing light absorbing substances and filter dyes as described in U.S. Pat. Nos. 3,253,921, 2,274,782, 2,527,583, and 2,956,879 can be used for the emulsion layers or protective layers for the emulsion layers. These layers can be mordanted for dyes as described, for example, in U.S. Pat. No. 3,282,699. Matting agents such as starch, titanium dioxide, zinc oxide, silica, and polymer beads including beads as described in U.S. Pat. Nos. 2,992,101 and 2,701,245 can be added to the emulsions or protective layers for the emulsion layers of the present invention. The degree of matting of the emulsion surfaces is not particularly limited unless stardust trouble is not produced. However, the degree is preferably from 1,000 seconds or more to 10,000 seconds or less in Beck's smoothness, and more preferably from 2,000 seconds or more to 10,000 seconds or less.

Binders for the emulsion layers of the present invention can be arbitrarily selected from among natural or synthetic resins such as gelatin, polyvinyl acetal, polyvinyl chloride, polyvinyl acetate, cellulose acetate, polyolefins, poly-esters, polystyrene, polyacrylonitrile, and polycarbonates. It is a matter of course to include copolymers and terpolymers therein. Preferred polymers are polyvinyl butyral, butyl ethyl cellulose, methacrylate copolymers, maleic anhydride ester copolymers, polystyrene, and butadiene-styrene copolymers. Combinations of two or more of these polymers can also be used as needed. Such polymers are employed in amounts sufficient to keep components therein, that is, in amounts effective to function as binders. The effective range of the amount can be appropriately determined by the manufacturers. As a guide to keeping the organic salts in the binders, the ratio of the binders to the organic salts preferably ranges from 15:1 to 1:2, and particularly preferably from 8:1 to 1:1.

In the present invention, the photothermographic emulsions can be applied to various supports. Examples of typical supports include polyester films, undercoated polyester films, poly(ethylene terephthalate) films, polyethylene naphthalate films, cellulose nitrate films, cellulose ester films, poly(vinyl acetal) films, polycarbonate films and related or resinous materials, glass, paper, and metals. Flexible bases, particularly partially acetylated, or baryta- and/or α-olefin polymer-coated paper supports, are typically employed, the α-olefin polymers including polyethylene, polypropylene, and ethylene-butene copolymers, which are prepared from α-olefins having 2 to 10 carbon atoms. Although said supports may be either transparent or translucent, it is preferred to be transparent.

The photosensitive materials in the present invention may contain antistatic or electro-conductive layers, for example, layers containing soluble salts (for example, chlorides or nitrates), deposited metal layers, layers containing ionic polymers as described in U.S. Pat. Nos. 2,861,056 and 3,206,312, insoluble inorganic salts as described in U.S. Pat. No. 3,428,451, or the like.

The photothermographic emulsions of the present invention can be applied according to various coating operations which include dipping coating, air-knife coating, flow coating, extruding coating by use of hoppers as described in U.S. Pat. No. 2,681,294. Two or more layers can be simultaneously formed by methods described in U.S. Pat. No. 2,761,791 and British Patent 837,095.

The photothermographic material of the present invention can contain additional layers, for example, a dye receiving layer for transfer dye images, an opaqueness enhancement layer required by reflux printing, a protective top coat layer, a primer layer known in the photo-thermographic technique. In the photosensitive material of the present invention, it is preferred that image formation can be performed with only one sheet of the photosensitive material, so that a functional layer necessary to form images, such as a receiving layer, does not need to be formed on a different sensitive material.

The present invention is illustrated with reference to the following examples. However, the present invention is not limited by these examples.

EXAMPLE 1

To 12 liters of water, 840 g of behenic acid and 95 g of stearic acid were added, and 48 g of sodium hydroxide and 63 g of sodium carbonate dissolved in 1.5 liters of water were added to the mixture maintained at 90° C. After stirring for 30 minutes, the resulting mixture was cooled to 50° C., and 1.1 liters of an 1% aqueous solution of N-bromosuccinimide were added, and subsequently, 2.3 liters of a 17% aqueous solution of silver nitrate were gradually added with stirring. The resulting mixture was further cooled to 35° C., and 1.5 liters of a 2% aqueous solution of potassium bromide were added to the mixture with stirring over a 2-minute period. After stirring for 30 minutes, 2.4 liters of an 1% aqueous solution of N-bromosuccinimide were added to the mixture. To this aqueous mixture, 3,300 g of an 1.2 wt % polyvinyl acetate solution in butyl acetate was added with stirring, and then the resulting mixture was allowed to stand for 10 minutes, which was separated into two layers. The aqueous layer was removed, and the residual gel was washed twice with water. The gel thus prepared, a mixture of silver behenate/stearate and silver bromide, was dispersed into 1,800 g of a 2.6% polyvinyl butyral (average molecular weight: 3,000) solution in isopropyl alcohol, and the resulting dispersion was further dispersed with 600 g of polyvinyl butyral (average molecular weight: 4,000) and 300 g of isopropyl alcohol to obtain emulsion a.

To 24 liters of water, 200 g of gelatin (average molecular weight: 70,000), 1.35 liters of 10% phosphoric acid, and 0.27 g of potassium bromide were added, and 4,320 g of aqueous silver nitrate and aqueous potassium bromide were added to the solution maintained at 30° C. by the controlled double jet method over a 10-minute period at a constant flow rate of silver nitrate, while maintaining pAg to 8.1. After terminating the addition, 880 ml of an 1N sodium oxide were added to the reaction mixture. Thereafter, the temperature was maintained at 35° C., and soluble salts were removed by a sedimentation method. The emulsion thus prepared was cubic grains with an average grain size of 0.06 μm and a standard deviation of 10%. The silver bromide emulsion thus prepared was added so as to be 43 g in terms of silver ten minutes before the addition of silver nitrate in the preparation of emulsion a. Thus, emulsion b was prepared in a manner similar to that of emulsion a, except that the amount of the aqueous silver nitrate added was 2.05 liters and potassium bromide was not added.

To 770 g of emulsion a thus prepared, 5 ml of a 0.015 wt % methanol solution of dye 1–6, 4 ml of a 0.1 wt % methanol solution of sodium p-methylphenylsulfinate, 7.2 g of phthalazinone, and 14 g of compound A were added to prepare emulsion layer coating solution a-1. Emulsion b was used in place of emulsion a to similarly prepare emulsion layer coating solution b-1. These emulsion layer coating solutions were applied to 175 μm-thick polyethylene terephthalate supports so as to be 2 g/m$^2$ in terms of silver. To emulsion a, dye 1-1, dye 1-12, and comparative dye 2 were added, respectively, to prepare emulsion layer coating solutions a-2, a-3, and a-4, and 5 ml of a 0.75 wt % solution of comparative dye 2 was added to emulsion a to prepare emulsion layer coating solution a-5. Further, to emulsion b, dye 1-1, dye 1-12, and comparative dye 2 were added, respectively, to prepare emulsion layer coating solutions b-2, b-3, and b-4, and 5 ml of a 0.75 wt % solution of comparative dye 2 was added to emulsion b to prepare emulsion layer coating solution b-5.

Compound A

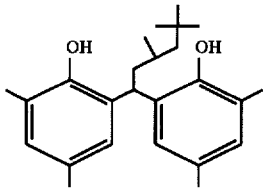

Comparative Dye 2

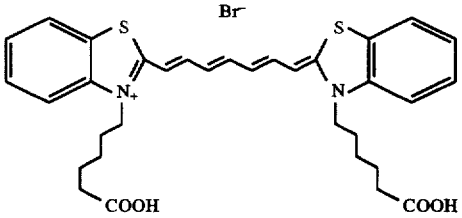

A 10% acetone solution of cellulose acetate was used as a surface protective layer for the emulsion layers, and coated so as to be 8 μm in dry thickness.

To 900 g of isopropyl alcohol, 106 g of polyvinyl butyral was added with stirring. A dispersion of 1 g of colloidal silica (particle size: 10 μm) in 220 g of isopropyl alcohol was added to the solution, and the resulting mixture was stirred for 30 minutes, to which 270 g of 0.65 wt % dimethylformamide solution of compound B were added. After the mixture was further stirred for 30 minutes, this coating solution was applied to the side opposite side to the emulsion layer of the support prior to application of the emulsions so that absorbance at 820 nm became 1.2.

Compound B

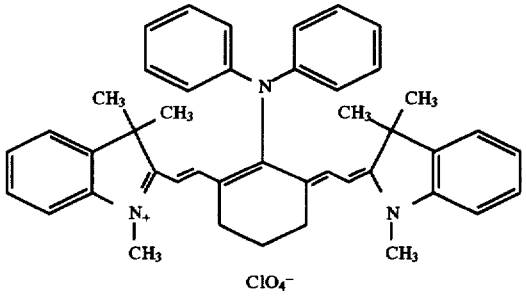

Thus, photosensitive materials a-1 to a-5 and b-1 to b-5 corresponding to the emulsion layer coating solutions a-1 to a-5 and b-1 to b-5 were prepared, respectively.

(Evaluation of Photographic Properties)

The photographic materials were subjected to exposure by use of a laser sensitometer equipped with a 820-nm diode, and processed (developed) at 120° C. for 15 seconds. Evaluation of images thus obtained were performed with a densitometer. Results of the measurements were evaluated through Dmin and sensitivity (a reciprocal of the ratio of an exposure amount giving density higher by 1.0 than Dmin).

(Evaluation of Natural Aging Storability)

Similarly to the evaluation of transportability, the samples each were allowed to stand under the conditions of 25° C.-50%RH for one day. Thereafter, 10 sheets of the respective photographic materials were enclosed up in envelopes made of a moistureproof material, and further placed in a decorative case (35.1 cm×26.9 cm×3.0 cm) to undergo aging test at 50° C. for 5 days. (enforced aging). These samples and samples which similarly underwent forced aging for comparison, except that the samples were stored at 4° C., were processed in a manner similar to that in the evaluation of photographic properties to measure densities of fog portions. The rate of fog increase was defined as the natural aging properties.

Rate of Fog Increase=[{(fog of forced aging sample)−(fog of comparative sample)}/{(maximum density of comparative sample)−(density of support)}]×100

Lower rates of fog increase indicate that the samples possess better natural aging properties.

(Evaluation of Image Stability against Light Irradiation)

The photosensitive materials which were exposed to light and developed in a manner similar to that in the evaluation of photographic properties were stuck on the inside of windowpanes through which direct sunshine past, and were allowed to stand for one month. Changes of images were then inspected with the naked eye, and evaluated according the following standards:

◎ Little change was observed.

○ Slight change in color tone was observed, but did not reach the extent of attracting attention.

Δ A Color fading in image portions was observed, but was acceptable for practical use.

x Color fading in Dmin caused increase in density to be unacceptable for practical use.

(Evaluation of Image Stability against Heat in the Dark)

The photosensitive materials which were exposed to light and developed in a manner similar to that in the evaluation of photographic properties were allowed to stand under light-shielding conditions at 40° C. for one month. Changes of images were then inspected with the naked eye, and evaluated according to the following standards:

◎ Little change was not observed.

○ Slight change in color tone was observed, but did not reach the extent of attracting attention.

Δ Color fading in image portions was observed, but was acceptable for practical use.

x Color fading in Dmin caused increase in density to be unacceptable for practical use.

Results of the above-mentioned evaluation as to each of these samples are shown in Table 1. Sensitivity of each photosensitivity materials was determined on the assumption that the sensitivity of photosensitive material a-1 was 100.

TABLE 1

| Photosensitive Material | Dmin | Sensitivity | Rate of Fog Increase | Color Fading due to Light | Color Fading due to Heat in the Dark | Notes |
|---|---|---|---|---|---|---|
| a-1 | 0.10 | 100 | 0 | ○ | ○ | Present Invention |
| a-2 | 0.11 | 110 | 0 | ○ | ○ | Present Invention |
| a-3 | 0.09 | 97 | 1 | ◎ | ○ | Present Invention |
| a-4 | 0.19 | 10 | 10 | Δ | X | Comparative Example |
| a-5 | 0.56 | 85 | 65 | X | X | Comparative Example |
| b-1 | 0.09 | 120 | 0 | ◎ | ◎ | Present |

TABLE 1-continued

| Photo-sensi-tive Material | Dmin | Sensi-tivity | Rate of Fog Increase | Color Fading due to Light | Color Fading due to Heat in the Dark | Notes |
|---|---|---|---|---|---|---|
| b-2 | 0.09 | 112 | 1 | ○ | ◎ | Invention Present |
| b-3 | 0.09 | 115 | 0 | ◎ | ◎ | Invention Present |
| b-4 | 0.22 | 5 | 15 | Δ | Δ | Invention Comparative Example |
| b-5 | 0.66 | 90 | 70 | X | X | Comparative Example |

Table 1 reveals that the present invention can provide photosensitive materials which possess high sensitivity, low fogging, and satisfactory storability.

EXAMPLE 2

(Emulsion A)

Full soap of silver behenate (307 g) containing 10 wt % of silver iodobromide (Br: 98 mol %, 1:2 mol %) which had been prepared beforehand was homogenized with toluene (545 g), butanone (1,634 g), and polyvinyl butyral having an average molecular weight of 4,000 (13.5 g).

(Emulsion B)

Emulsion B was prepared similarly to emulsion A, except that the silver halide was not contained.

Under safelight containing no blue light, 100 g of emulsion A and 100 g of emulsion B were dispersed into 50 ml of 2-butanone at 25° C., and 30 g of polyvinyl butyral (average molecular weight: 4,000), 0.2 g of pyridinium hydrobromide perbromide (in 3 ml of methanol), and 1 ml of lithium bromide (10% methanol solution) were added to the dispersion, and mixed. The resulting mixture was allowed to stand overnight at 10° C. Further, 10 ml of 2-(4-chlorobenzoyl)benzoic acid (12% methanol solution), 10 ml of 2-mercaptobenzimidazole (1% methanol solution), and 7 g of compound A were added to the mixture at 25° C. Subsequently, under safelight containing no infrared rays, a 0.01% solution of dye 1-5 in a mixed solvent consisting of methanol and phenoxyethanol (1:1) was added in an amount of $5\times10^{-4}$ mole per mole of silver halide to prepare an emulsion layer coating solution. An emulsion layer coating solution to which the solution of dye 1-5 was not added was also prepared. The emulsion layer coating solutions were applied to a 175 μm-thick polyethylene terephthalate support on which a undercoat layer was not formed, so as to be 2 g/m$^2$ in terms of silver, and dried at 70° for 4 minutes.

A mixture of 150 ml of acetone, 67 ml of 2-butanone, 30 ml of methanol, 9.0 g of cellulose acetate, 1.0 g of phthalazine, 0.7 g of 4-methylphthalic acid, 0.6 g of tetrachlorophthalic acid, 0.65 g of tetrachlorophthalic anhydride, and 0.5 g of silicon dioxide (particle size: 2 μm) was applied to the emulsion layer to form a surface protective layer having a wet thickness of 100 μm, and dried at 70° C. for 4 minutes.

Prior to the formation of the surface protective layer on the emulsion layer, a backing layer was provided on the support so as to have absorbance of 1.2 at 820 nm, and dried at 75° C. for 4 minutes. The coating solution for the backing layer was a mixture of 6 g of polyvinyl butyral (average molecular weight: 4,000), 69 g of butanone, 30 g of a mixture of methanol and butanone (1:1), 0.5 g of silicon dioxide (particle size: 10 μm), and 0.05 g of compound B.

The photosensitive material thus prepared was taken as photosensitive material c-1, and photosensitive materials in which dye 1-10, comparative dye 3, and comparative dye 4 were employed in place of dye 1-5 were taken as photosensitive materials c-2, c-3 and c-4, respectively.

Comparative dye 3

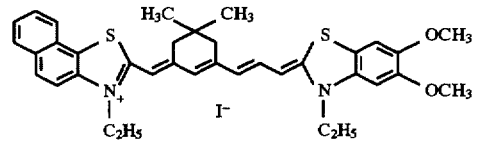

Comparative dye 4

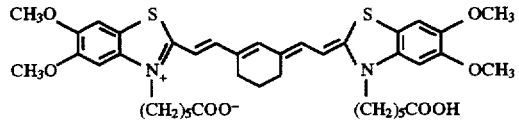

Results evaluated similarly to Example 1 about each of these samples are shown in Table 2. Sensitivity of each samples was determined on the assumption that the sensitivity of photosensitive material c-1 was 100.

TABLE 2

| Photo-sensi-tive Material | Dmin | Sensi-tivity | Rate of Fog Increase | Color Fading due to Light | Color Fading due to Heat in the Dark | Notes |
|---|---|---|---|---|---|---|
| c-1 | 0.11 | 100 | 1 | ○ | ○ | Present Invention |
| c-2 | 0.11 | 105 | 2 | ○ | ○ | Present Invention |
| c-3 | 0.23 | 10 | 15 | X | X | Comparative Example |
| c-4 | 0.20 | 15 | 20 | X | X | Comparative Example |

Table 2 reveals that the present invention can provide photosensitive materials which possess high sensitivity, low fogging, and satisfactory storability.

EXAMPLE 3

Sample Nos. 3b-1 to 3b-10 were prepared in the same manner as in Example 1, except for using emulsion b and adding 5 ml of 0.1 wt % solution of comparative dye 5, dyes 1-1, 1-5, 1-10, 1-15, 1-26, 1-29, 1-34, 1-38 and 1-44, respectively.

Comparative Dye 5

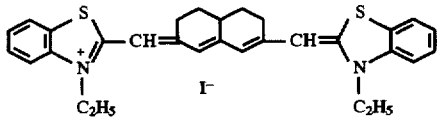

(Evaluation of Photographic Properties)

The photographic materials were subjected to exposure by use of a laser sensitometer equipped with a 820-nm diode, and processed (developed) at 120° C. for 15 seconds. Evaluation of images thus obtained were performed with a densitometer. Results of the measurements were evaluated through Dmin and sensitivity (a reciprocal of the ratio of an exposure amount giving density higher by 1.0 than Dmin). Sensitivity of each samples was determined on the assumption that the sensitivity of photosensitive material 1-01 was 100.

(Evaluation of Natural Aging Storability)

Similarly to the evaluation of transportability, the samples each were allowed to stand under the conditions of 25° C.-50%RH for one day. Thereafter, 10 sheets of the respective photographic materials were enclosed up in envelopes made of a moistureproof material, and further placed in a decorative case (35.1 cm×26.9 cm×3.0 cm) to undergo aging test at 50° C. for 7 days. Results of the measurements were evaluated through Dmin and sensitivity. Sensitivity of each samples was determined on the assumption that the sensitivity of photosensitive material 1-01, which was not subjected to the aging test, was 100. A sample where the exposure amount giving density higher by 1.0 than Dmin was not obtained was represented by "–".

The results obtained are shown in Table 3 below.

TABLE 3

| Sample | Sensitivity | Dmin | Sensitivity After Aging | Dmin After Aging | Remarks |
|---|---|---|---|---|---|
| 3b-1 | 100 | 0.20 | 5 | 0.50 | Comparison |
| 3b-2 | 200 | 0.10 | 220 | 0.11 | Invention |
| 3b-3 | 220 | 0.11 | 200 | 0.11 | " |
| 3b-4 | 180 | 0.10 | 180 | 0.10 | " |
| 3b-5 | 200 | 0.12 | 200 | 0.12 | " |
| 3b-6 | 220 | 0.09 | 220 | 0.10 | " |
| 3b-7 | 220 | 0.10 | 240 | 0.11 | " |
| 3b-8 | 180 | 0.12 | 200 | 0.12 | " |
| 3b-9 | 200 | 0.10 | 180 | 0.10 | " |
| 3b-10 | 220 | 0.10 | 200 | 0.12 | " |

Table 3 reveals that the present invention can provide photosensitive materials which possess high sensitivity and satisfactory storability.

It should further be apparent to those skilled in the art that various changes in form and detail of the invention as shown and described above may be made. It is intended that such changes be inclined within the spirit and scope of the claimed appended hereto.

What is claimed is:

1. A photothermographic material containing on at least one side of a support a binder, an organic silver salt, a reducing agent for silver ion, and photosensitive silver halide grains, wherein the photothermographic material contains a cyanine dye having a quinoline nucleus and at least one of an alkylthio group, an arylthio group, a thioether substituent or a substituent having a thioether group.

2. A photothermographic material claimed in claim 1, wherein the photosensitive silver halide grains are spectrally sensitized in the range of 750 to 1,400 nm.

3. A photothermographic material claimed as in claim 1, wherein the cyanine dye has at least one substituent group having a thioether bond.

4. A photothermographic material as claimed in claim 1, in which the cyanine dye is represented by the following formula (I):

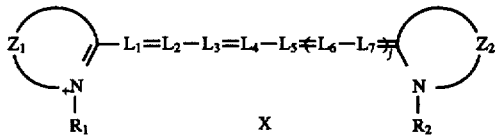

(I)

wherein $R_1$ and $R_2$ each represents an alkyl group; $Z_1$ is an atomic group for completing a quinoline nucleus; $Z_2$ represents an atomic group necessary to complete a 5- or 6-membered nitrogen-containing heterocycle; $L_1$, $L_2$, $L_3$, $L_4$, $L_5$, $L_6$, and $L_7$ each represents a methine group, or $L_2$ and $L_4$, $L_3$ and $L_5$or $L_4$ and $L_6$ may bond to each other to form a ring; j represents 0 or 1; X represents a counter ion to keep balance of the electric charges, or X may represent a substituent group on $Z_1$, $Z_2$, $R_1$ or $R_2$ to form an internal salt with the cyanine dye; and at least one of $R_1$, $R_2$, $L_1$ and $L_2$ is substituted by an alkylthio group, an arylthio group or a substituent group having a thioether bond.

5. A photothermographic material claimed in claim 4, wherein, in formula (I), at least one of $R_1$, $R_2$, $Z_1$ and $Z_2$ are substituted with a substituent group having a thioether bond.

6. A photothermographic material claimed in claim 4, wherein, in formula (I), at least one of $R_1$ and $R_2$ are substituted with an alkylthio group, an arylthio group and a substituent group having a thioether bond.

7. The photothermographic material of claim 1, wherein said cyanine dye has a $C_1$–$C_8$ alkylthio group that is optionally substituted by a group selected from the group consisting of an aryl group, an alkylthio group, an alkoxy group, a hydroxyalkyl group and a halogen atom.

8. The photothermographic material of claim 1, wherein said cyanine dye has a phenylthio group that is optionally substituted by a group selected from the group consisting of an alkyl group, an alkylthio group, an alkoxy group, a hydroxyalkyl group, a halogen atom and a hydroxy group.

9. The photothermographic material of claim 1, wherein said cyanine dye has a thioether substituent or a substituent having a thioether group that is an alkylthioalkyl group having from 2 to 6 carbon atoms or phenylthioalkyl group having from 7 to 10 carbon atoms, wherein said thioether group is optionally substituted by a group selected from the group consisting of an alkyl group, an alkylthio group, an alkoxy group, a hydroxyalkyl group, a halogen atom and a hydroxy group.

10. The photothermographic material of claim 4, wherein the methine groups $L_1$ to $L_7$ are each optionally substituted by a group selected from the group consisting of an alkyl group, an aryl group, an aralkyl group, an alkoxy group, an alkylthio group, an arylthio group, and an amino group; and/or $L_1$ and $L_2$, $L_3$ and $L_5$ or $L_4$ and $L_6$ are combined to form a ring structure selected from the group consisting of

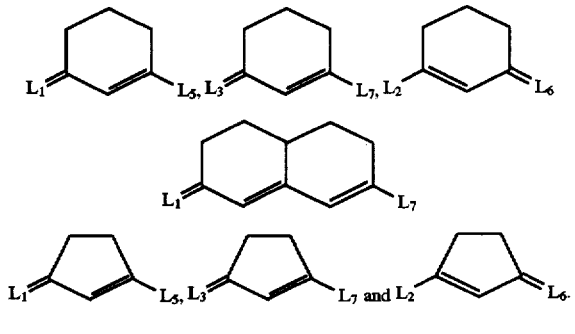

* * * * *